United States Patent [19]

Davis et al.

[11] Patent Number: 4,705,483

[45] Date of Patent: Nov. 10, 1987

[54] TREE LIGHT WIRING HARNESS

[76] Inventors: William R. Davis, 9801 Mission Rd., Overland Park, Kans. 66206; Lawrence E. Davis, 10431 Barton, Overland Park, Kans. 66214

[21] Appl. No.: 946,765

[22] Filed: Dec. 29, 1986

[51] Int. Cl.[4] ..... H01R 11/00

[52] U.S. Cl. ..... 439/502; 439/541

[58] Field of Search ..... 339/28, 29, 119 R, 119 L, 339/121, 151 C; 439/502, 527, 541, 540, 626

[56] References Cited

U.S. PATENT DOCUMENTS

| | | | |
|---|---|---|---|
| 1,843,389 | 2/1932 | Fischer | 339/28 |
| 1,891,341 | 12/1932 | Barocas | 339/119 L |
| 2,201,045 | 5/1940 | Lundstrom | 339/28 |
| 2,277,532 | 3/1942 | Smith | 339/155 R |
| 2,465,419 | 3/1949 | Barany | 339/49 R |
| 3,403,371 | 9/1968 | Mitcham | 339/28 |
| 3,662,319 | 5/1972 | Culver | 339/28 |

FOREIGN PATENT DOCUMENTS 25815 10/1986 Taiwan .

*Primary Examiner*—Gil Weidenfeld
*Assistant Examiner*—Paula A. Austin
*Attorney, Agent, or Firm*—Schmidt, Johnson, Hovey & Williams

[57] ABSTRACT

A wiring harness is provided which, among other uses, allows quick and convenient installation of lights on a Christmas tree. Preferably, the wiring harness includes a flexible, resilient, C-shaped ring body having a channel-shaped cross section with an interior surface; a plurality of electrical receptacles received within a corresponding plurality of cavities defined in the interior surface of the ring member; and a conductor pair electrically intercoupling the receptacles with an electrical plug. In advantageous use, the harness, with a plurality of strands of tree lights already plugged into the receptacles, is spread apart, placed about the upper boughs of the tree and released whereupon the essential labor is completed for placing the lights on the tree.

4 Claims, 3 Drawing Figures

TREE LIGHT WIRING HARNESS

BACKGROUND OF THE INVENTION

1. Field of the Invention

This invention relates to a wiring harness which flexibly and resiliently conforms to the upper boughs of a tree for quick and convenient installation of lights thereon. More particularly, this invention is concerned with a flexible, resilient, C-shaped ring body including a plurality of electrical receptacles coupled thereto with the receptacles electrically intercoupled with an electrical plug and which advantageously includes a corresponding plurality of strands of tree lights respectively coupled to the receptacles.

2. Description of the Prior Art

The placement of lights on a Christmas tree can be time consuming and inconvenient. Conventional light strands include a plug at one end and a receptacle at the other with a plurality of decorative lamps therebetween. Typical installation requires these strands of lights to be serially connected and strung about the tree in a desired aesthetic configuration. Additionally, the strands of lights must be placed so that they are supported by the limbs and branches of the tree. Removal of the lights is similarly time consuming and inconvenient.

Outdoor installation of light strands presents particular problems in addition to those discussed above because of the risk of rain and snow penetrating and shorting out electrical connections at the plug-receptacle unions.

SUMMARY OF THE INVENTION

The problems outlined above are solved by the wiring harness and illumination system described herein. That is to say, the wiring harness hereof allows quick and convenient installation and removal of decorative light strands from trees and, among other uses, prevents direct rain and snow contact with the plug-receptacle unions of the light strands.

Broadly speaking, the wiring harness includes a flexible, resilient, C-shaped ring body; an electrical receptacle; means for coupling the receptacle with the ring body; and means for electrically coupling the receptacle with a source of electrical power.

Preferably, the ring body presents a channel-shaped cross section including an interior surface and a plurality of receptacles respectively received in a corresponding plurality of cavities defined in the interior surface. A pair of electrical conductors electrically intercouples the receptacles with an electrical plug adapted for coupling with a source of electrical power. Desirably, an auxiliary receptacle, remote from the ring body, is electrically coupled with the pair of conductors. Advantageously, the receptacles each include a pair of tubular prong-receiving elements for receiving the correspondingly configured prongs of a plug coupled with a light strand.

The present invention additionally provides for a tree illumination system by including a corresponding plurality of light strands with the wiring harness.

DESCRIPTION OF THE PREFERRED EMBODIMENT

Figure 1:
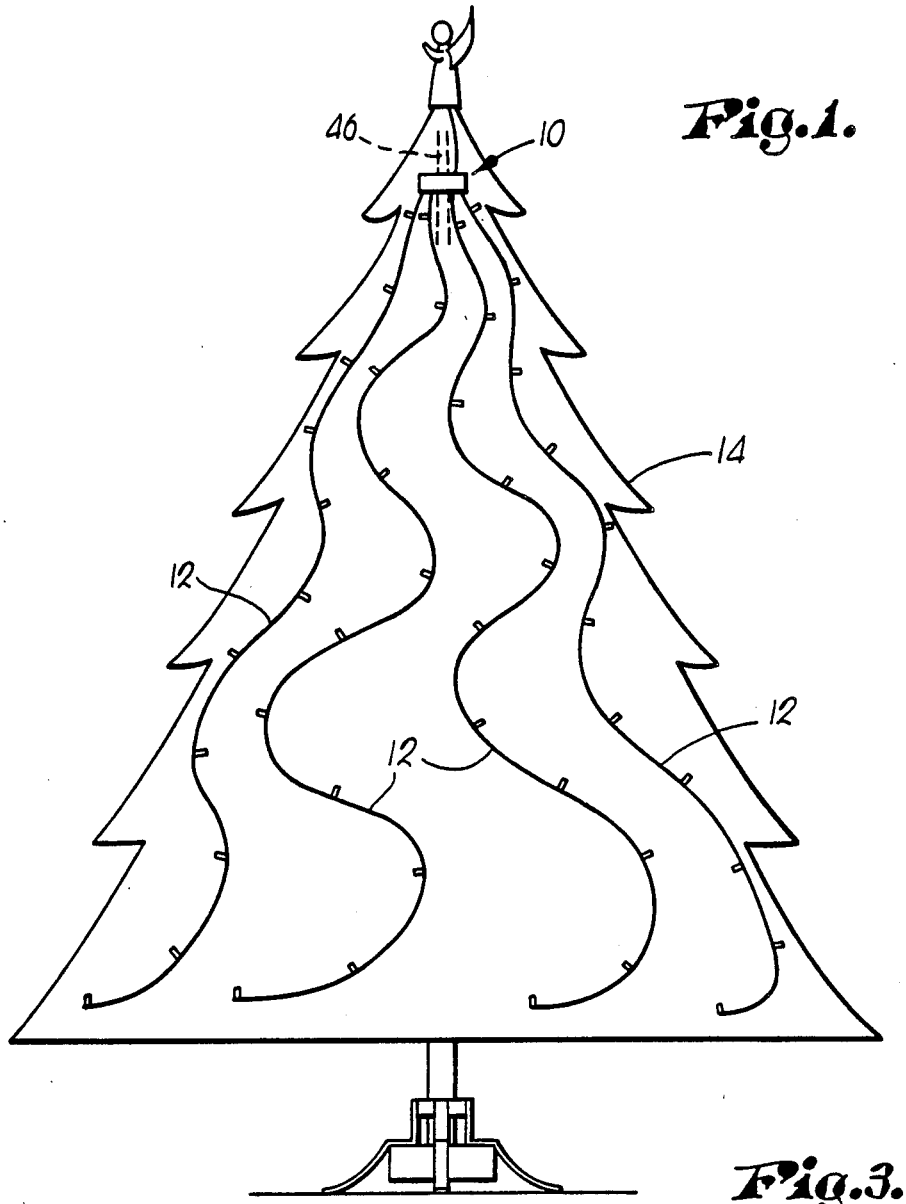
FIG. 1 is a side elevational view of the wiring harness and illumination system in the preferred environment of use on a Christmas tree.

FIG. 1 illustrates wiring harness 10 coupled with a plurality of light strands 12 in the preferred environment of use on Christmas tree 14. The preferred environment of use shown in FIG. 1 is provided for descriptive illustration only and is not to be considered limiting in that the present invention contemplates many other uses.

Wiring harness 10 broadly includes ring body 16, six electrical receptacles 18, auxiliary electrical receptacle 20, six receptacle-coupling cavities 22, and electrical coupling assembly 24.

Figure 2:
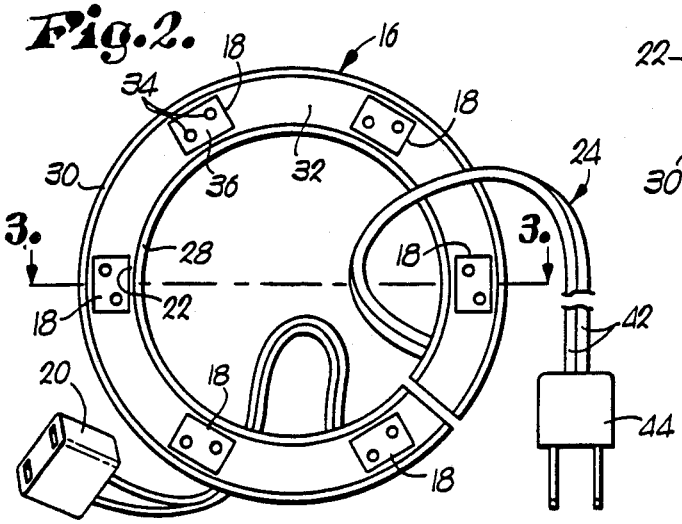
FIG. 2 is a bottom plan view of the wiring harness.
Figure 3:
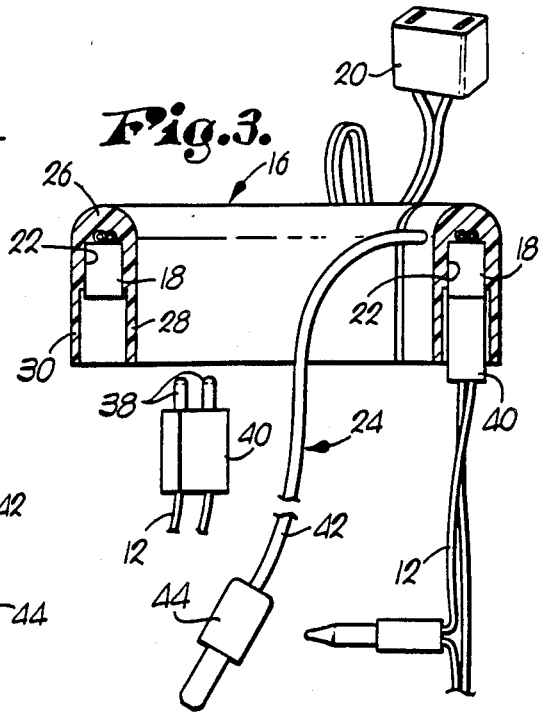
FIG. 3 is a side view in partial section of the wiring harness.

Flexible, resilient ring body 16 can be composed of any sturdy, flexible, resilient material but neoprene rubber is preferred. Body 16 presents a C-shaped configuration as shown in FIG. 2 which nearly closes a full circle with only a narrow gap between the ends thereof. Body 16 also presents a channel-shaped cross sectional configuration as shown in FIG. 3 and integrally includes ring member 26 presenting a semi-circular cross section, inner wall 28 depending therefrom, and outer wall 30 also depending therefrom parallel to and spaced apart from inner wall 28. Ring member 26 presents an interior surface 32 disposed between and normal to walls 28 and 30.

Electrical receptacles 18 are conventional 120 volt a.c. electrical receptacles except that each receptacle 18 includes a pair of tubular receptacle elements 34 disposed adjacent opposed diagonal corners of coupling face 36 rather than the standard slotted type receptacle elements. Each pair of receptacle elements 34 disposed on a given receptacle 18 is adapted to receive a pair of respective tubular prongs 38 correspondingly configured as part of an otherwise conventional light strand plug 40 coupled at the end of each light strand 12. The provision of receptacle elements 34 and prongs 38 is preferred to ensure secure mating between a given plug 40 and a given receptacle 18. A conventional light strand plug with a pair of outwardly extending tines and a conventional receptacle with corresponding configured slotted receiving elements would function acceptably but would not provide the secure slidable contact of the preferred cylindrical prongs 38 and tubular receptacle elements 34.

Equally-spaced, receptacle-coupling cavities 22 are defined in inner surface 32 and are configured to respectively receive receptacles 18 therein with coupling face 36 exposed for use.

Electrical coupling assembly 24 includes a pair of electrical conductors 42 and conventional electrical plug 44 electrically coupled with conductors 42. Plug 44 is conventionally adapted to couple with a standard household receptacle. Auxiliary receptacle 20 is preferably a conventional receptacle and is electrically coupled to the ends of conductors 42 opposed from plug 44. Auxiliary receptacle 20 is disposed remote from ring body 16 as shown in FIGS. 2 and 3.

In the manufacture of wiring harness 10, receptacles 18 and auxiliary receptacle 20 are first coupled to electrical conductors 42 according to known conventional techniques. This entire assembly is then placed in a mold along with the unformed rubber composing ring body 16. The entire assembly making up wiring harness 10 is then molded so that ring body 16 is formed around conductors 42 and receptacles 18. This method of manufacture is preferred to ensure that electrical receptacles 18 are snugly received within coupling cavities 22 and to inhibit moisture penetration.

In the preferred use of the present invention, six light strands 12 are coupled with receptacles 18 to form a complete illumination system. Upon removal of harness 10 and light strands 12 from a storage package, the user spreads apart ring body 16 places it about the upper portion of tree trunk 46, and releases it thereby coupling harness 10 to tree 14. Light strands 12 depending from wire harness 10 can then be aesthetically arranged in a manner suitable to the user. Auxiliary receptacle 20 is provided for conventional electrical coupling with a decorative tree top display, for example. In this way, the placement of harness 10 and light strands 12 is accomplished quickly and conveniently.

FIG. 3 illustrates how the channel-shaped configuration of ring body 16 aids in preventing rain and snow penetration into harness 10 and receptacles 18. With this design, wiring harness 10 can be placed on a tree out-of-doors with assurance that receptacles 18 will not be shorted out by direct contact with rain or snow.

Those skilled in the art will appreciate that the present invention contemplates many variations in the preferred embodiment and uses described herein. For example, receptacles 18, 20 and electrical coupling assembly 24 can be designed for other voltage levels with corresponding and appropriate changes in the configurations of these components to conform to convention and applicable codes.

Having thus described in detail the preferred embodiment of the present invention, what is claimed as new and desired to be secured by Letters Patent is:

1. A wiring harness for providing electrical power from a source thereof to an electrical load, said wiring harness comprising:

a flexible, resilient, C-shaped ring body;

an electrical receptacle;

means for coupling said receptacle with said ring body; and means for electrically coupling said receptacle with a source of electrical power;

wherein said receptacle coupling means includes a receptacle-receiving cavity defined in said ring body for receiving said receptacle therein;

said ring body presents a channel-shaped cross sectional configuration and includes a ring member, an inner wall depending therefrom, and a outer wall depending therefrom parallel to and spaced apart from said inner wall, said ring member includes an interior surface disposed between said inner wall and said outer wall, said interior surface includes said cavity;

said harness includes a plurality of said receptacles and a corresponding plurality of said cavities;

wherein said electrical coupling means includes an electrical plug adapted for electrically coupling with a source of electrical power and includes a pair of conductors electrically coupled with said plug and said receptacles.

2. The wiring harness as set forth in claim 1, further includes an auxiliary receptacle electrically coupled with said plug and disposed remote from said body.

3. The wiring harness as set forth in claim 1, wherein said receptacle presents a rectangular coupling surface and includes a pair of tubular, axially-parallel, electrically conducting, prong-receiving elements received therein normal to said surface, said elements being disposed adjacent opposed diagonal corners of said surface and adapted for receiving therein correspondingly configured cylindrical prongs of an electrical load plug.

4. A tree illumination system comprising:

a flexible, resilient, C-shaped cross sectional configuration including a ring member, an inner wall depending therefrom, and an outer wall depending therefrom parallel to and spaced apart from said inner wall, said ring member including an interior surface disposed between said inner wall and said outer wall;

a plurality of electrical receptacles;

means for coupling said receptacles with said ring body including a corresponding plurality of receptacle-receiving cavities defined in said interior surface for respectively receiving said receptacles therein;

means for electrically coupling said receptacles with a source of electrical power including a plug adapted for electrically coupling with a source of electrical power, and a pair of electrical conductors electrically intercoupling said receptacles with said plug; and a corresponding plurality of light strands each including a plug adapted for electrically coupling with one of said receptacles.

* * * * *